US010018045B2

(12) United States Patent
Chang

(10) Patent No.: US 10,018,045 B2
(45) Date of Patent: Jul. 10, 2018

(54) PNEUMATIC MOTOR FOR A PNEUMATIC TOOL

(71) Applicant: AIRBOSS AIR TOOL CO., LTD., Taichung (TW)

(72) Inventor: Hsin-He Chang, Taichung (TW)

(73) Assignee: AIRBOSS AIR TOOL CO., LTD., Taichung (TW)

( * ) Notice: Subject to any disclaimer, the term of this patent is extended or adjusted under 35 U.S.C. 154(b) by 134 days.

(21) Appl. No.: 15/198,951

(22) Filed: Jun. 30, 2016

(65) Prior Publication Data

US 2018/0003059 A1 Jan. 4, 2018

(51) Int. Cl.

| | |
|---|---|
| ***F03C 2/00*** | (2006.01) |
| ***F03C 4/00*** | (2006.01) |
| ***F04C 2/00*** | (2006.01) |
| ***F01C 21/08*** | (2006.01) |
| ***F04C 2/344*** | (2006.01) |

(52) U.S. Cl.

CPC ..... *F01C 21/0836* (2013.01); *F01C 21/0809* (2013.01); *F04C 2/344* (2013.01); *F04C 2240/20* (2013.01); *F04C 2250/20* (2013.01); *F05B 2220/00* (2013.01); *F05B 2240/2023* (2013.01)

(58) Field of Classification Search

CPC ..... F01C 21/0863; F01C 21/0809; F05B 2220/00; F05B 2240/2023; B25F 5/00; F04C 2/344; F04C 2240/20; F04C 2250/20

USPC ..... 418/148, 259, 266–268

See application file for complete search history.

(56) References Cited

U.S. PATENT DOCUMENTS

| | | | | |
|---|---|---|---|---|
| 3,469,500 | A * | 9/1969 | Lutz | F01C 21/0809 418/2 |
| 3,981,647 | A * | 9/1976 | Schoeps | F01C 21/0809 418/241 |
| 5,501,586 | A * | 3/1996 | Edwards | F01C 21/08 418/15 |
| 5,879,146 | A * | 3/1999 | Van De Voort | F01C 21/0809 418/259 |
| 5,954,141 | A * | 9/1999 | Li | B25B 21/00 173/109 |
| 6,776,136 | B1 * | 8/2004 | Kazempour | F04C 2/344 418/147 |
| 2014/0271316 | A1 * | 9/2014 | Beal | F01C 21/0836 418/261 |

* cited by examiner

*Primary Examiner* — Theresa Trieu

(74) *Attorney, Agent, or Firm* — Rabin & Berdo, P.C.

(57) ABSTRACT

A pneumatic motor has a housing, an axle, and multiple blades. The axle is rotatably mounted in the housing and has multiple blade recesses. The blades are mounted respectively and moveably in the blade recesses. Each blade has an inner side edge. The inner side edge is mounted in a corresponding one of the blade recesses. The inner side edge of each one of at least half of the multiple blades has a straight segment and a rectangular tab. Each one of the blade recesses which holds the blade having the straight segment and the rectangular tab has a bottom having a straight segment and a tab hole.

13 Claims, 10 Drawing Sheets

PNEUMATIC MOTOR FOR A PNEUMATIC TOOL

BACKGROUND OF THE INVENTION

1. Field of the Invention

The present invention relates to a pneumatic motor, and more particularly to a pneumatic motor for a pneumatic tool to have an enhanced structural strength.

2. Description of Related Art

A pneumatic motor is mounted in a pneumatic tool. When pressured air is led into the pneumatic motor, the pneumatic motor is rotated to drive a tool to rotate. With reference to FIGS. 9 to 11, a conventional pneumatic motor comprises a housing 50, an axle 60, and multiple blades 70. The housing 50 has an inlet 51 and an outlet 52. The inlet 51 is connected with a pressured air source. The axle 60 is rotatably mounted in the housing 50 and is eccentric to the housing 50. The axle 60 has multiple blade recesses 62 radially defined in the axle 60. The blades 70 are mounted respectively and movably in the blade recesses 62 of the axle 60. When pressured air is led into the housing 50 via the inlet 51, the blades 70 are pushed by the pressured air to rotate the axle 60 so as to output a driving force to a tool.

However, each blade 70 of the conventional pneumatic motor has a curved side edge 72, so the bottoms 622 of the blade recesses 62 are also curved for corresponding to the curved side edges 72 of the blades 70. Thus, the thickness of the axle 60 at a position being adjacent to an axis of the axle 60 is thin, but the portion being adjacent to the axis of the axle 60 has to bear a large load while the axle 60 is pushed to rotate by the pressured air. Therefore, the axle 60 is easily damaged, and the useful life of the pneumatic motor is reduced. Accordingly, the conventional pneumatic motor usually has six blades 70, such that the housing 50 is divided into six air chambers by the blades 70. However, each air chamber has a large volume, and the amount of the pressured air in each air chamber for pushing a corresponding blade 70 is large. Therefore, this will cause waste in use of the pressured air, and the torque provided by the pneumatic air is also limited.

In addition, to increase the number the air chamber and to reduce the volume of each air chamber by increasing the number the blades 70, which will causes the thickness of the axle 60 at a position being adjacent to the axis of the axle 60 become thinner. Thus, the structural strength of the axle 60 is reduced and cannot bear a large load, so the conventional pneumatic motor is easily damaged and the useful life of the conventional pneumatic motor is shortened.

To overcome the shortcomings, the present invention tends to provide a pneumatic motor to mitigate or obviate the aforementioned problems.

SUMMARY OF THE INVENTION

The main objective of the invention is to provide a pneumatic motor that can increase the number of the air chambers and has an enhanced structural strength.

The pneumatic motor has a housing, an axle, and multiple blades. The housing has an inlet and an outlet. The axle is rotatably mounted in the housing and has multiple blade recesses radially defined in the axle. The blades are mounted respectively and moveably in the blade recesses in the axle. Each blade has an inner side edge and an outer side edge. The inner side edge is mounted in a corresponding one of the blade recesses. The outer side edge is opposite the inner side edge and extends out of the corresponding blade recess. The inner side edge of each one of at least half of the multiple blades has a straight segment and a rectangular tab. The straight segment is formed on the inner side edge. The rectangular tab is formed on and protrudes from a middle of the straight segment. Each one of the blade recesses which holds the blade having the straight segment and the rectangular tab has a bottom having a straight segment and a tab hole. The straight segment corresponds to the straight segment in position and shape. The tab hole has a rectangular cross section, is defined in a middle of the straight segment of the bottom of the blade recess, and selectively holds the rectangular tab on the corresponding blade inside.

Other objects, advantages and novel features of the invention will become more apparent from the following detailed description when taken in conjunction with the accompanying drawings.

DETAILED DESCRIPTION OF PREFERRED EMBODIMENT

Figure 1:
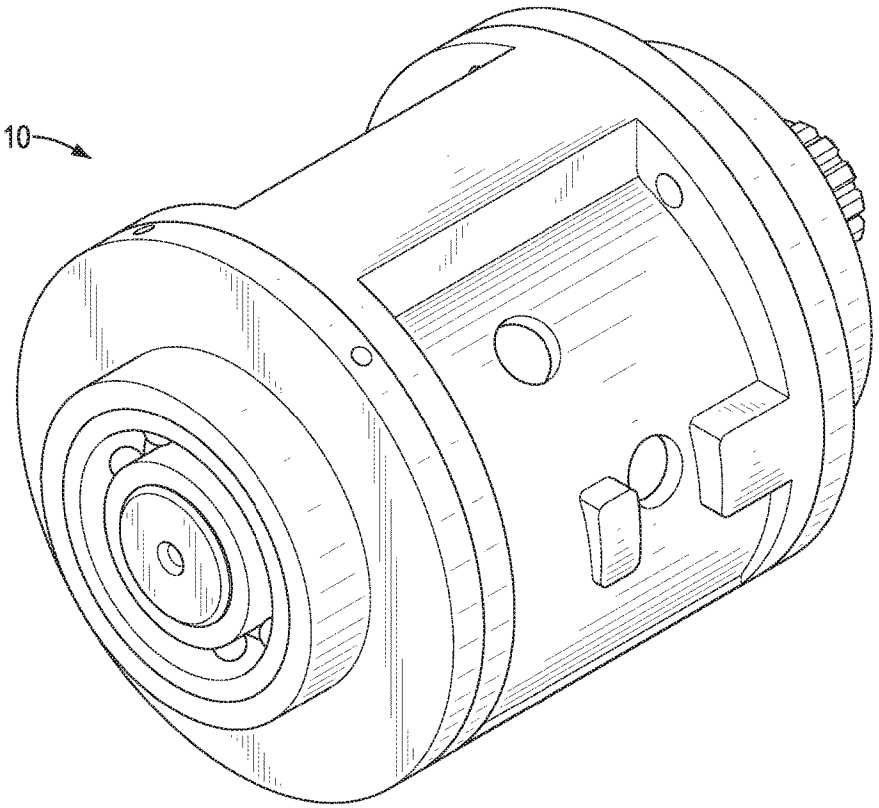
FIG. 1 is a perspective view of a pneumatic motor in accordance with the present invention.
Figure 2:
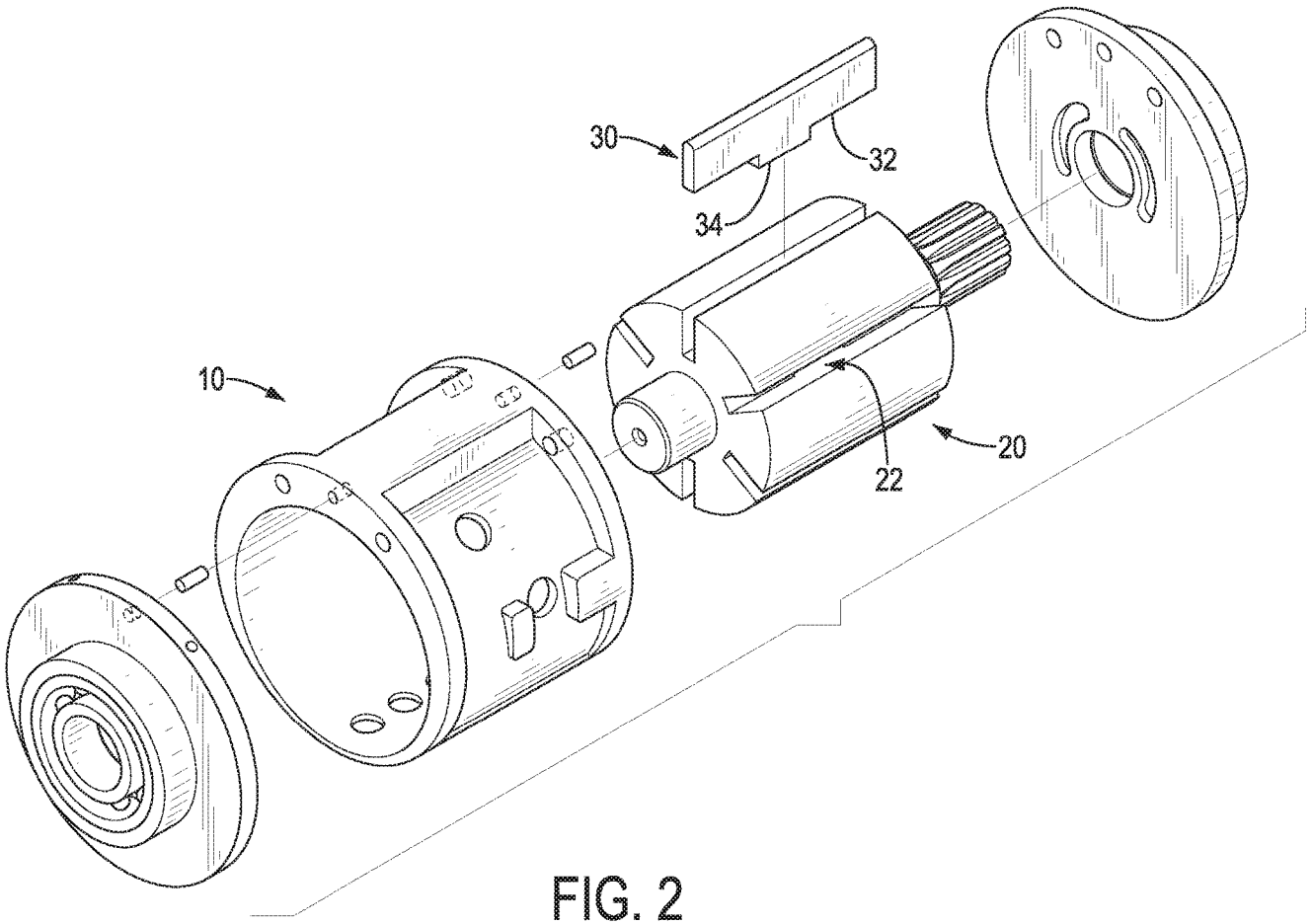
FIG. 2 is an exploded perspective view of a first embodiment of a pneumatic motor in accordance with the present invention.
Figure 11:
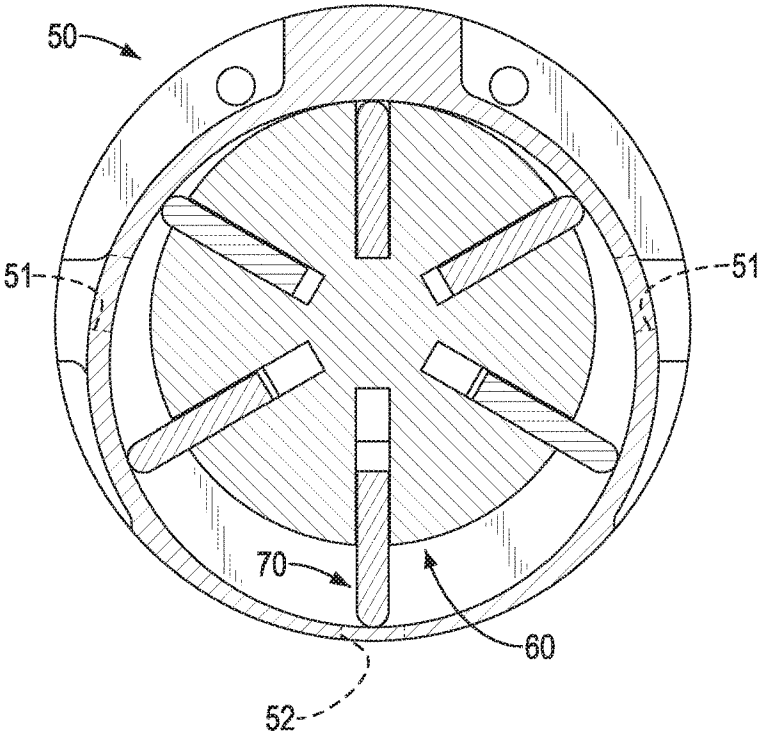
FIG. 11 PRIOR ART
FIG. 11 is an enlarged cross sectional end view of the conventional pneumatic motor in FIG. 9.
Figure 3:
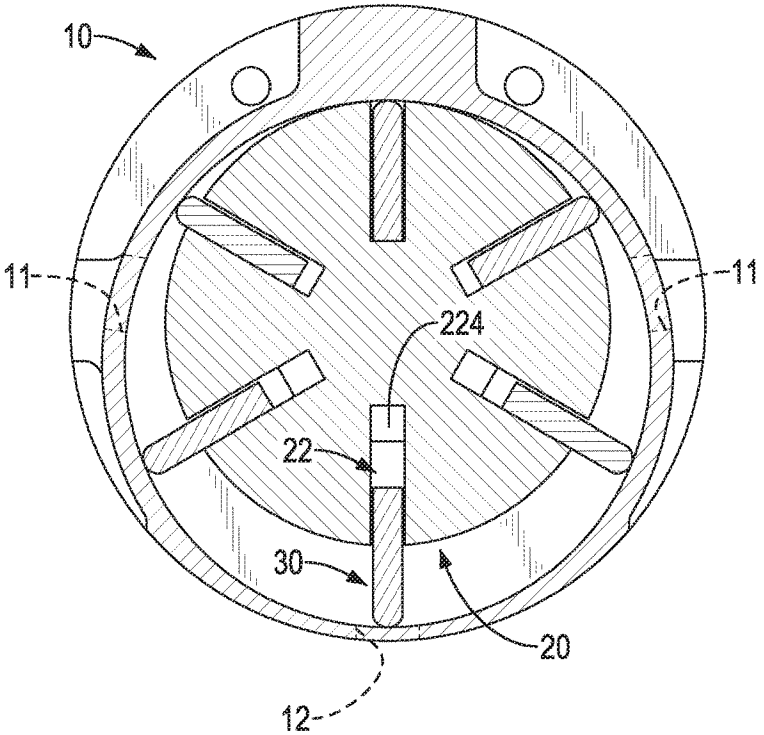
FIG. 3 is an enlarged cross sectional end view of the pneumatic motor in FIG. 2.

With reference to FIGS. 1 and 2, a pneumatic motor in accordance with the present invention comprises a housing 10, an axle 20, and multiple blades 30.

The housing 10 has an inlet 11 and an outlet 12. The axle 20 is rotatably mounted in the housing 10 and may be coaxial or eccentric to the housing 10. The axle 20 has multiple blade recesses 22 radially defined in the axle 20. The blades 30 are mounted respectively and moveably in the blade recesses 22 in the axle 20. Each blade 30 has an inner side edge and an outer side edge. The inner side edge is mounted in a corresponding one of the blade recesses 22. The outer side edge is opposite the inner side edge and extends out of the corresponding blade recess 22. The inner side edge of each blade 30 has a straight segment 32 and a rectangular tab 34. The straight segment 32 is formed on the inner side edge. The rectangular tab 34 is formed on and protrudes from a middle of the straight segment 32. Preferably, the rectangular tab 34 has a length smaller than one third of a length of the blade 30 on which the rectangular tab 34 is formed. Each blade recess 22 has a bottom having a straight segment 222 and a tab hole 224. The straight segment 222 corresponds to the straight segment 32 in position and shape. The tab hole 224 has a rectangular cross section, is defined in a middle of the straight segment 222 of the bottom of the blade recess 22, and selectively holds the rectangular tab 34 on the corresponding blade 30 inside.

Figure 4:
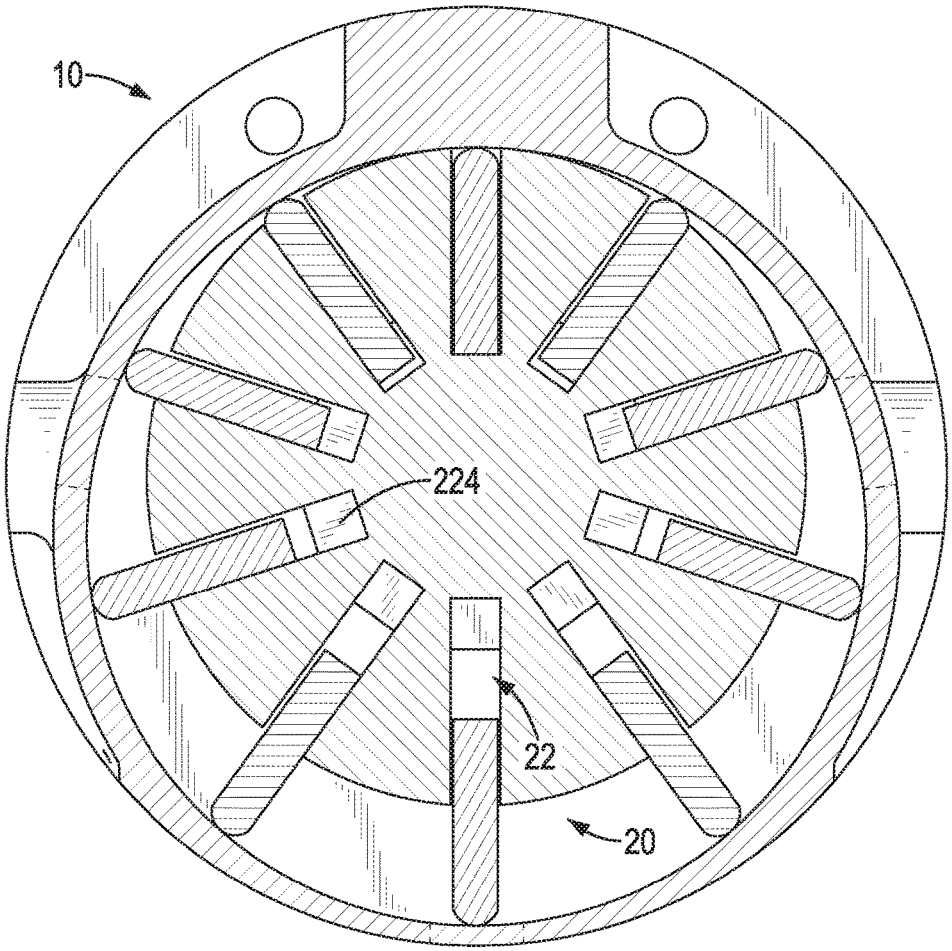
FIG. 4 is an enlarged cross sectional end view of a second embodiment of a pneumatic motor in accordance with the present invention.
Figure 5:
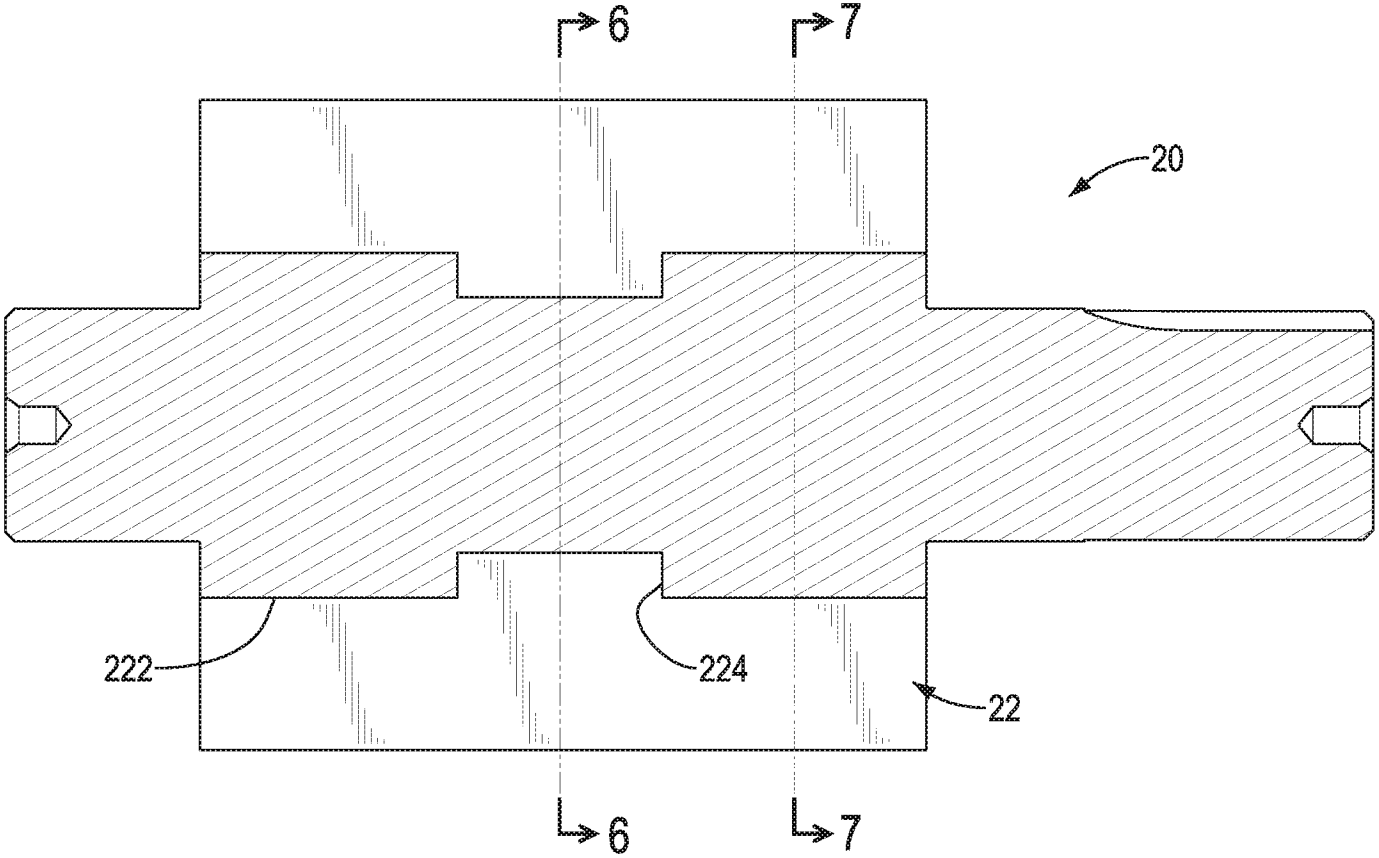
FIG. 5 is an enlarged cross sectional side view of an axle with blades of the pneumatic motor in FIG. 4.
Figure 6:
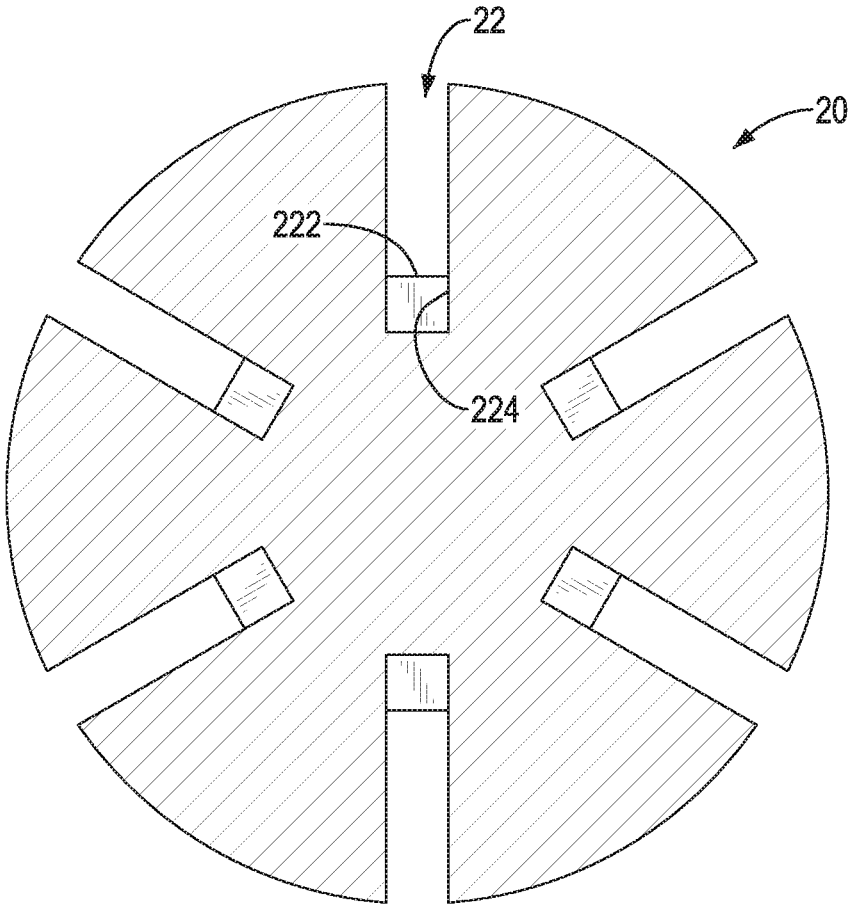
FIG. 6 is an enlarged cross sectional end view of the axle along the line 6-6 in FIG. 5.
Figure 7:
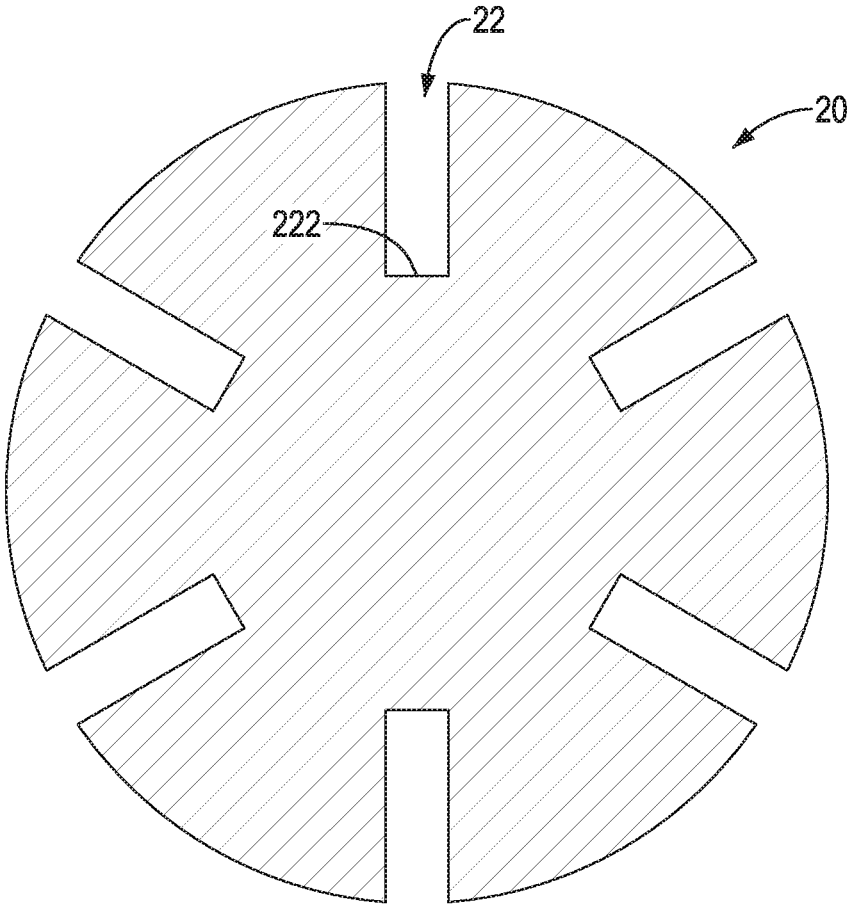
FIG. 7 is an enlarged cross sectional end view of the axle along the line 7-7 in FIG. 5.

With reference to FIGS. 5 to 7, because the bottom of each blade recess 22 has a straight segment 222, the axle 20 has a sufficient thickness at a position being adjacent to the axis of the axle 20. Although the axle 20 has a thin thickness at a position corresponding to the tab hole 224, the axle 20 still has a sufficient thickness at positions corresponding to two sides of the tab hole 224. Therefore, the axle 20 has a sufficient structural strength, such that the numbers of the blade recesses 22 and the blade 30 can be increased. Based on the experiment of the inventor, the number of the blades 30 can be increased to ten or twelve as shown in FIG. 4. Even when twelve blades 30 are implemented, the axle 20 still has a sufficient structural strength for bearing a large load.

Accordingly, the numbers of air chambers in the housing 10 can be increased, so the volume of the pressured air in each air chamber and discharged out from the outlet 12 can be effectively reduced. The axle 20 can be actually pushed to rotate by the pressured air, and the torque provided by the pneumatic motor can be increased and the operation efficiency of the pneumatic motor can be improved.

Figure 8:
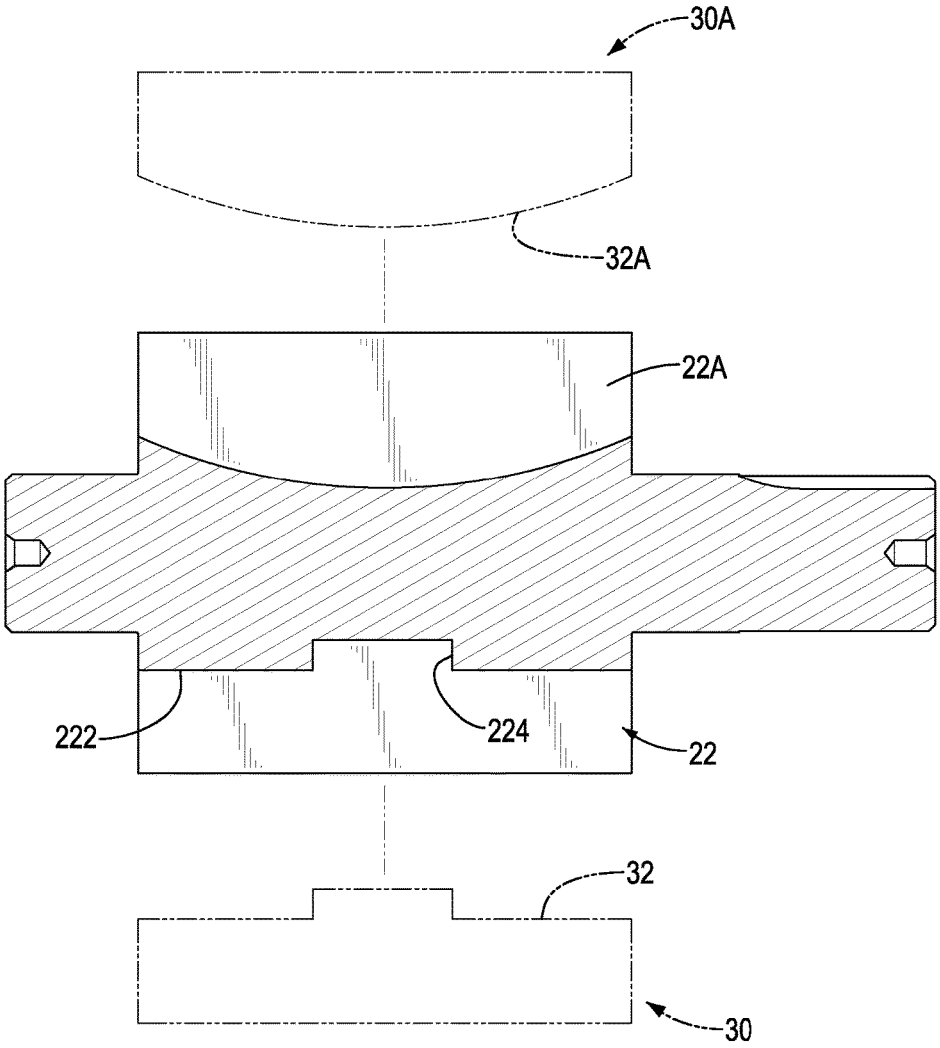
FIG. 8 is a cross sectional side view of a third embodiment of an axle of a pneumatic motor in accordance with the present invention.
Figure 9:
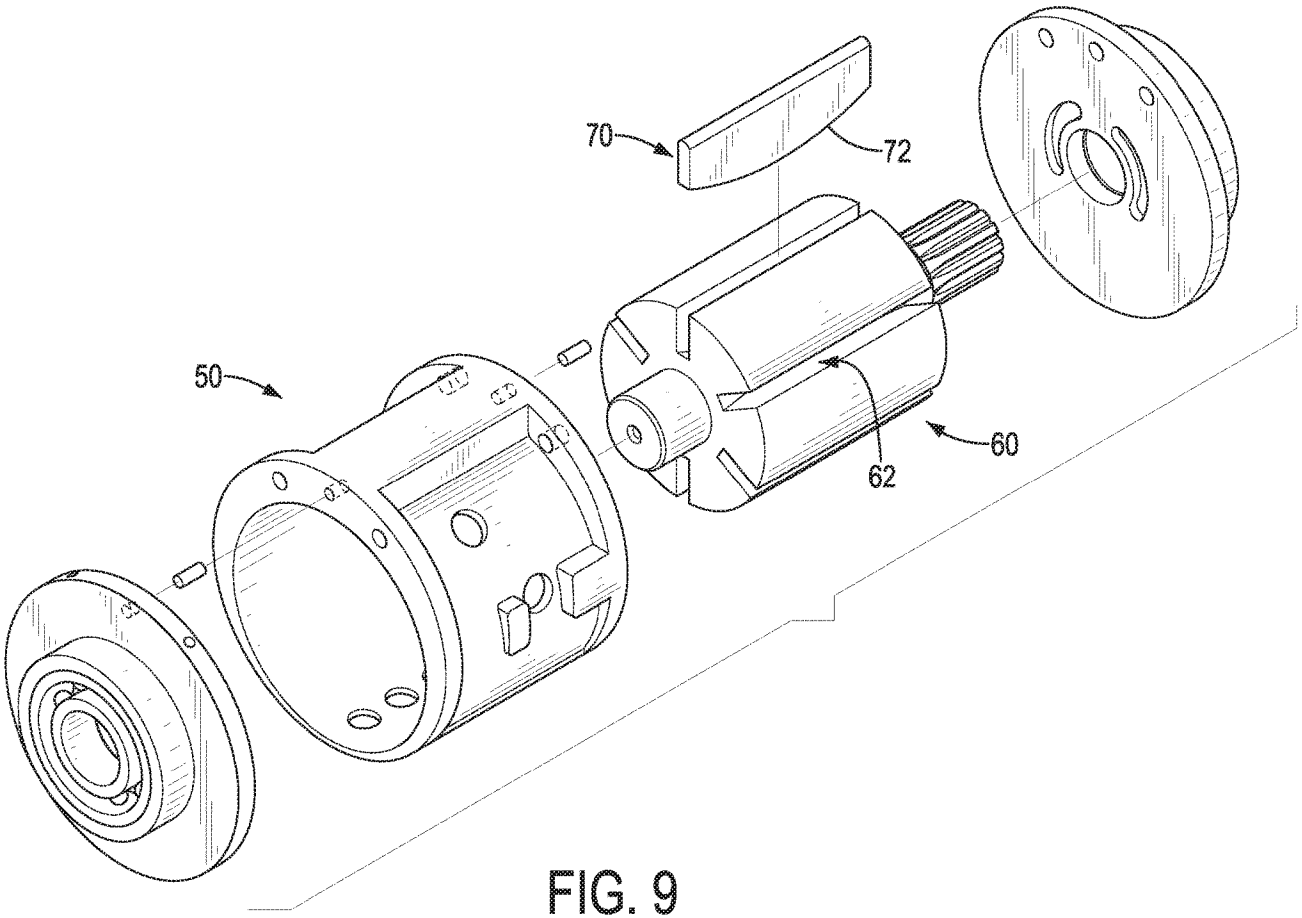
FIG. 9 PRIOR ART
FIG. 9 is an exploded perspective view of a conventional pneumatic motor.
Figure 10:
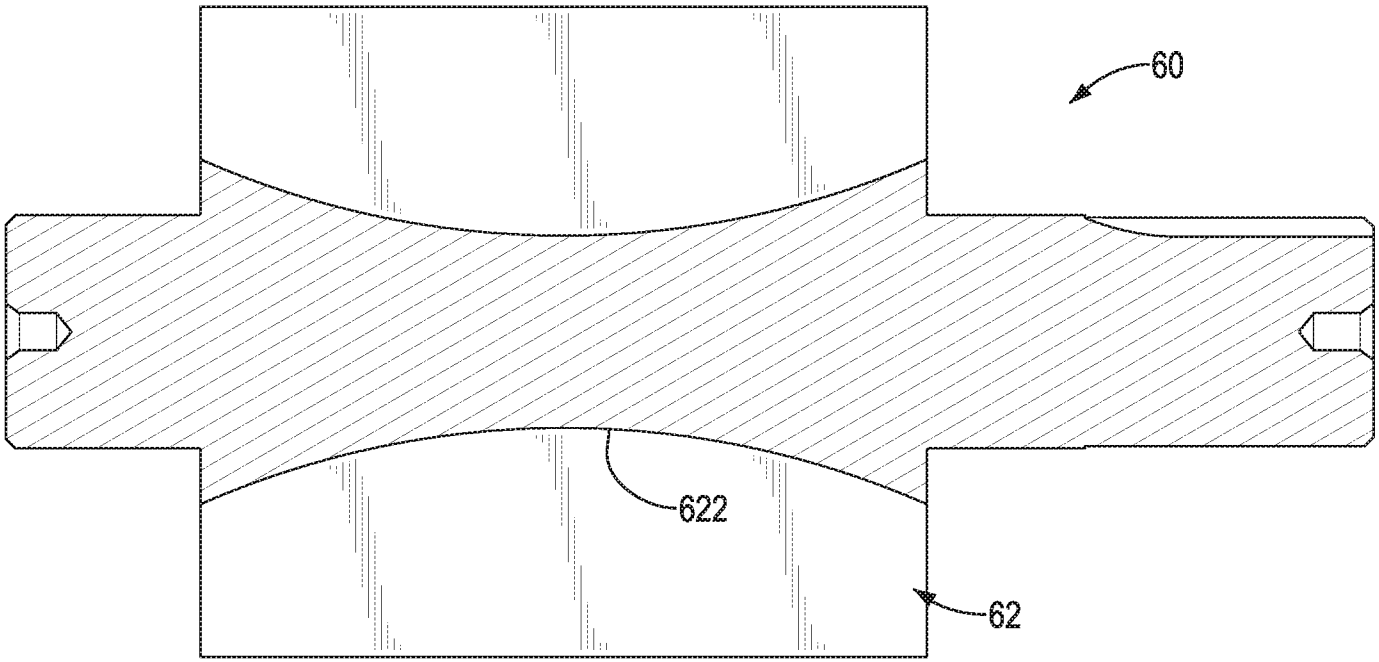
FIG. 10 PRIOR ART
FIG. 10 is an enlarged cross sectional side view of an axle of the conventional pneumatic motor in FIG. 9.

With reference to FIG. 8, part of the blade recesses 22 each have a bottom having a straight segment 222, and the other blade recesses 22A do not have a bottom having a straight segment 222 and each have a curved bottom. Therefore, blades 30 with a straight segment 32 and blades 30A with a curved inner side edge 32A can be mounted respectively in the blade recesses 22,22A with or without the straight segment 222 to fit with different operation demands Preferably, a number of the blade recesses 22 having the straight segment 222 is half of the multiple blade recesses 22. The blade recesses 22 having the straight segment 222 and the blade recesses 22A without the straight segment 222 are arranged in an alternate manner.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pneumatic motor comprising:
a housing having an inlet and an outlet;
an axle rotatably mounted in the housing and having multiple blade recesses radially defined in the axle;
multiple blades mounted respectively and moveably in the blade recesses in the axle, and each blade having
an inner side edge mounted in a corresponding one of the blade recesses; and
an outer side edge being opposite the inner side edge and extending out of the corresponding blade recess, wherein
the inner side edge of each one of at least half of the multiple blades has
a straight segment formed on the inner side edge; and
a rectangular tab formed on and protruding from a middle of the straight segment;
each one of the blade recesses which holds the blade having the straight segment and the rectangular tab has a bottom having
a straight segment corresponding to the straight segment of a corresponding one of the blades in position and shape; and
a tab hole having a rectangular cross section, defined in a middle of the straight segment of the bottom of the blade recess, and selectively holding the rectangular tab on the corresponding blade inside.

2. The pneumatic motor as claimed in claim 1, wherein more than six blades are implemented.

3. The pneumatic motor as claimed in claim 2, wherein ten blades are implemented.

4. The pneumatic motor as claimed in claim 3, wherein each rectangular tab has a length smaller than one third of a length of the blade on which the rectangular tab is formed.

5. The pneumatic motor as claimed in claim 4, wherein a number of the blade recesses having the straight segment is half of the multiple blade recesses.

6. The pneumatic motor as claimed in claim 5, wherein the blade recesses having the straight segment and the blade recesses without the straight segment are arranged in an alternate manner.

7. The pneumatic motor as claimed in claim 6, wherein each one of the blade recesses without the straight segment has a curved bottom; and
the inner side edge of each one of the blades without the straight segment is curved.

8. The pneumatic motor as claimed in claim 5, wherein each one of the blade recesses without the straight segment has a curved bottom; and
the inner side edge of each one of the blades without the straight segment is curved.

9. The pneumatic motor as claimed in claim 1, wherein each rectangular tab has a length smaller than one third of a length of the blade on which the rectangular tab is formed.

10. The pneumatic motor as claimed in claim 9, wherein a number of the blade recesses having the straight segment is half of the multiple blade recesses.

11. The pneumatic motor as claimed in claim 10, wherein the blades having the rectangular tab and the blades without the rectangular tab are arranged in an alternate manner.

12. The pneumatic motor as claimed in claim 11, wherein each one of the blade recesses without the straight segment has a curved bottom; and
the inner side edge of each one of the blades without the straight segment is curved.

13. The pneumatic motor as claimed in claim 10, wherein each one of the blade recesses without the straight segment has a curved bottom; and
the inner side edge of each one of the blades without the straight segment is curved.

* * * * *